United States Patent [19]

Jacobs et al.

[11] Patent Number: 4,769,578

[45] Date of Patent: Sep. 6, 1988

[54] HIGH-PRESSURE SODIUM DISCHARGE LAMP

[75] Inventors: Cornelis A. J. Jacobs, Bath, N.Y.; Hubertus M. J. Chermin, Eindhoven, Netherlands

[73] Assignee: U.S. Philips Corporation, New York, N.Y.

[21] Appl. No.: 746,216

[22] Filed: Jun. 18, 1985

[30] Foreign Application Priority Data

Jun. 18, 1984 [NL] Netherlands ..... 8401920

[51] Int. Cl.[4] ..... H05B 41/16; H05B 41/00

[52] U.S. Cl. ..... 315/60; 315/57; 315/223; 315/224; 315/243; 315/241 R

[58] Field of Search ..... 315/60, 57, DIG. 2, 315/DIG.5, 223, 224, 242, 105, 274, 307, 241 R, 243

[56] References Cited

U.S. PATENT DOCUMENTS

| | | | |
|---|---|---|---|
| 2,677,788 | 8/1947 | Germeshausen | 315/242 |
| 3,544,840 | 9/1968 | Saiger | 315/274 |
| 3,624,445 | 5/1970 | Cadwallader | 315/234 |
| 3,665,243 | 5/1972 | Kaneda et al. | 315/242 |
| 4,117,377 | 9/1978 | Jimerson et al. | 315/209 R |
| 4,223,247 | 9/1980 | Jacobs et al. | 315/60 |
| 4,350,929 | 9/1982 | Katoogi | 315/DIG. 5 |
| 4,375,045 | 2/1983 | Yim | 315/274 |
| 4,438,369 | 3/1984 | Hicks et al. | 315/49 |
| 4,488,091 | 12/1984 | Muzeroll et al. | 315/60 |

FOREIGN PATENT DOCUMENTS

| | | | |
|---|---|---|---|
| 757067 | 9/1956 | United Kingdom | 315/DIG. 5 |

*Primary Examiner*—David K. Moore
*Assistant Examiner*—Michael Razavi
*Attorney, Agent, or Firm*—David R. Treacy; Bernard Franzblau

[57] ABSTRACT

A high-pressure sodium discharge lamp comprising a discharge vessel (3) provided with an external auxiliary electrode (11) and a built-in electric starting circuit including an electric circuit comprising a transformer winding (35*a*), a capacitor (33) and a semiconductor switching element (34). The circuit is connected in series with a resistor (32) electrically parallel to the discharge vessel (3) and with the transformer (35) electrically connected to the external auxiliary electrode (11). The semiconductor switching element (34) is an uncontrolled voltage-dependent breakdown element of the thyristor type having a breakdown current smaller than 1 mA at a breakdown time shorter than 10 μs. The resultant lamp starts very reliably and its build-in starter dissipates only a very low power.

18 Claims, 2 Drawing Sheets

HIGH-PRESSURE SODIUM DISCHARGE LAMP

This invention relates to a high-pressure sodium discharge lamp comprising a discharge vessel provided with two main electrodes, between which a stable discharge extends in the operating condition. The discharge vessel is further provided with an external auxiliary electrode. The lamp is further provided with an electric starting circuit including an electric circuit comprising a primary transformer winding, a first capacitor and a semiconductor switching element, which circuit is connected in a series arrangement with a first resistor with said arrangement electrically connected in parallel between the two main electrodes and electrically connected via a secondary transformer winding to the external auxiliary electrode.

A lamp of the kind mentioned in the opening paragraph is known from U.S. Pat. No. 4,447,759. Such a lamp is generally operated with alternating voltage. In the known lamp, the semiconductor switching element is a controlled semiconductor switching element of the bidirectional thyristor type. The known circuit requires that a switching current for switching the semiconductor switching element, which is at least 2 mA, be supplied during starting of the lamp. However, this results in a comparatively large current also flowing through the starting circuit parallel to the lamp current in the operating condition of the lamp, which adversely affects the lamp efficiency. Besides, in the case of a lamp which does not start immediately, the starting circuit may carry a comparatively large current for a long time, as a result of which a considerable amount of heat is developed. The heat developed is found to be so large in practical cases that the temperature in the area of the first capacitor and/or the semiconductor switching element exceeds a permissible maximum value, which leads to the first capacitor and/or the semiconductor switching element becoming defective and hence to the life of the lamp ending prematurely.

The invention has for an object to provide means by which the said disadvantages can be avoided. For this purpose, according to the invention, a lamp of the kind mentioned in the opening paragraph is characterized in that the semiconductor switching element is an uncontrolled voltage-dependent breakdown element of the uni- or bidirectional thyristor type having a breakdown current smaller than 1 mA at a breakdown time shorter than 10 μs. The small breakdown current has the advantage that on the one hand the resistor in series with the electric circuit can be very large and on the other hand a comparatively small first capacitor in the electric circuit is sufficient. A large value of the resistor in the electric starting circuit ensures that in the operating condition only a very small current flows through the electric starting circuit, which has a favourable influence on the lamp efficiency. A comparatively small first capacitor has the additional advantage that the voltage across this capacitor will lag only slightly behind the applied voltage, as a result of which the breakdown of the semiconductor element, and hence the starting pulse at the external auxiliary electrode, generally occurs when the applied voltage is large. This is beneficial to a quick starting of the lamp.

The expression "voltage-dependent breakdown element" is to be understood in this description to mean an element which breaks down when the voltage across the element exceeds a threshold characteristic of the element and further designated as the breakdown voltage. The breakdown voltage should be chosen so that during a stable operation of the lamp, breakdown does not occur. On the other hand, it is necessary for the breakdown voltage to be smaller than the minimum peak value of the supply voltage applied to the main electrodes of the lamp. It is advantageous for a quick starting of the lamp to choose the breakdown voltage as low as possible. This offers the possibility that two or more starting pulses are produced per half cycle of the alternating voltage to which the lamp is connected, which is generally very beneficial to a quick starting of the lamp. For lamps operated at an alternating supply voltage frequently used in practice having an effective value of 220 V and a minimum peak value of about 310 V, the breakdown voltage is preferably chosen in the range of from 220 V to about 280 V.

A short breakdown time is beneficial to the formation of a high starting pulse. The influence of the breakdown time on the height of the starting pulse is larger as the first capacitor is smaller.

A semiconductor switching element suitable for a lamp according to the invention is known, for example, from U.S. Pat. No. 3,866,088. Although in the said Patent the semiconductor switching element is shown in starting circuits for discharge lamps, in all cases starting circuits are concerned which are separate from the lamp. Moreover, in the case of high-pressure sodium discharge lamps, lamps without an external auxiliary electrode are concerned so that the starting pulses produced in and by the starting circuit are directly supplied to the main electrodes of the respective lamps. Furthermore, such starting pulses are also supplied to stabilization ballasts, by means of which the lamps are operated, which entails that the stabilization ballast thus used has to be protected from overload by the starting pulses.

Preferably, in a lamp according to the invention, the semiconductor switching element in the electric circuit is arranged between the first capacitor and the transformer primary winding and the first capacitor is directly connected to the first resistor. This preferred configuration ensures that the instant at which the semiconductor switching element breaks down is independent of the transformer primary winding.

When the lamp is started, the voltage pulse produced by the starting circuit ensures that a glow discharge is obtained in the discharge vessel. For a subsequent increase of the lamp current, the glow discharge produced has to be maintained by means of energy supplied from the supply source to which the lamp is connected. However, it has been found that immediately after breakdown of the semiconductor switching element the voltage across the lamp exhibits an abrupt decrease, as a result of which the maintenance of the glow discharge and hence a further increase of the lamp current is adversely affected.

In a further preferred embodiment of the lamp according to the invention, the discharge vessel is electrically shunted by a series arrangement of a second resistor and a second capacitor. By means of this series arrangement, immediately after breakdown of the semiconductor switching element the voltage across the discharge vessel is kept substantially constant. Moreover, the ionization in the discharge vessel is maintained over a period of a few μs, which is sufficient to initiate the supply of current from the connected supply source. Thus, the current increase and hence starting of the lamp is accelerated, which in general favourably influences the life of the lamp.

Embodiments of lamps according to the invention will be described, by way of example, with reference to the accompanying drawings in which:

FIG. 4 shows a modification of FIG. 3, while

FIG. 5*a, b, c* shows part of the voltage variation during starting of the lamp.

Figure 1:
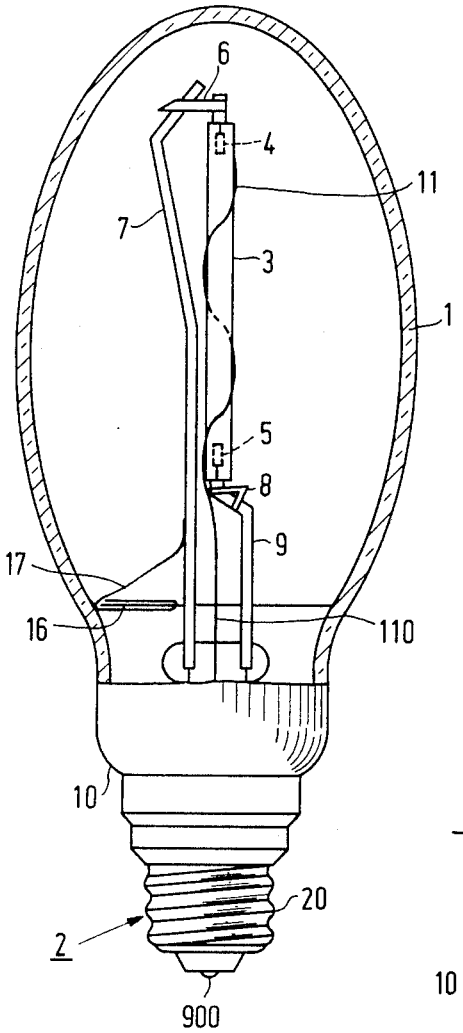
FIG. 1 shows a lamp partly broken away.

In FIG. 1, reference numeral 1 denotes an outer bulb of the lamp with a neck 10 to which a lamp cap 2 with a sleeve 20 is secured. The outer bulb 1 encloses a discharge vessel 3. The discharge vessel 3 is provided with two main electrodes 4 and 5, between which a stable discharge extends in the operating condition of the lamp. The electrode 4 is electrically and mechanically connected by means of a metal strip 6 and via a supply conductor 7 to the sleeve 20. The electrode 5 is electrically connected by means of a metal strip 8 and via a supply conductor 9 to the connection contact 900 of the lamp cap 2. The discharge vessel 3 is provided with an external auxiliary electrode 11.

In the outer bulb 1 there is further mounted an aluminium heat shield 16 between the discharge vessel 3 and the neck 10. The heat shield 16 reflects infrared radiation originating from the discharge vessel and thus prevents this infrared radiation from causing a temperature increase of the elements of an electric circuit present in the lamp cap 2.

A nickel strip 17 is welded to the supply conductor 7 and grips around the heat shield 16 while clampingly surrounding it and thus positioning the heat shield in a simple and efficacious manner.

Figure 2:
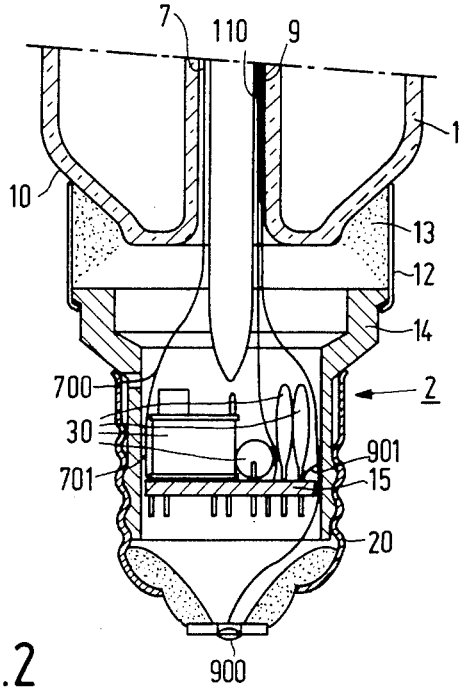
FIG. 2 is a sectional view of the lamp cap of the lamp shown in FIG. 1.

The lamp cap 2 is shown in section in FIG. 2, in which a metal ring 12 is secured by means of cement 13 to the neck 10 of the outer bulb 1 of the lamp. The metal ring 12 surrounds with a clamping fit an end of an electrically insulating moulding 14 of synthetic material on the side remote from the neck. Other electrically insulating materials suitable for the moulding 14 are, for example, ceramic material and glass. The sleeve 20 is secured on the other end of the moulding 14 of synthetic material by means of a screw-thread. The moulding 14 of synthetic material encloses a circuit board 15, on which elements 30 of an electric starting circuit are arranged. The electric starting circuit is electrically connected via connections 701 and 901 to the supply conductors 7 and 9, respectively, and is connected via the supply conductor 110 to the external auxiliary electrode 11. The supply conductor 7 is connected by the connection contact 700 to the sleeve 20.

Figure 3:
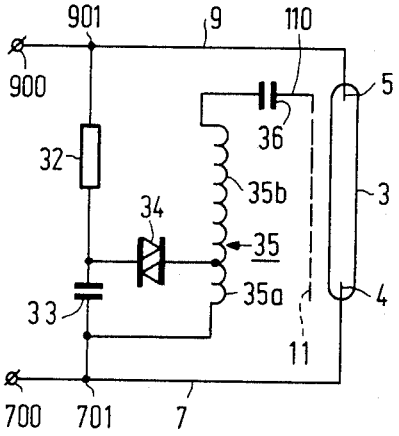
FIG. 3 shows an electric circuit diagram of the lamp of FIG. 1.

FIG. 3 shows the electric circuit diagram of the lamp according to FIG. 1, in which the main electrode 5 of the discharge vessel 3 is electrically connected to the connection contact 900 via the supply conductor 9. The main electrode 4 is electrically connected via the supply conductor 7 to the connection contact 700. An electric starting circuit is connected electrically parallel between the main electrodes 4 and 5. The starting circuit is connected on the one hand via the connection contact 701 to the supply conductor 7 and on the other hand via the connection contact 901 to the supply conductor 9. The starting circuit comprises a first resistor 32 in series with an electric circuit comprising a first capacitor 33, a transformer primary winding 35*a* of the transformer 35 and a semiconductor switching element 34. The first capacitor 33 and the semiconductor switching element are directly connected to the first resistor 32 and the first capacitor 33 and the transformer primary winding 35*a* are directly connected to the connection contact 701. A transformer secondary winding 35*b* of the transformer 35 is electrically connected via a further blocking capacitor 36 and the supply conductor 110 to the external auxiliary electrode 11.

In a modification of the electric circuit, the semiconductor switching element 34 is connected between the resistor 32 and the connection contact 701 and the first capacitor 33 and the transformer winding 35*a* form a series-combination which is arranged in parallel across the semiconductor switching element 34. The semiconductor switching element is a voltage-dependent breakdown element of the thyristor type. The operation of the circuit arrangement described is as follows:

When an alternating voltage is applied as a supply voltage to the connection contacts 700 and 900, the first capacitor 33 is charged via the first resistor 32. When the voltage across the first capacitor 33 reaches the breakdown voltage of the semiconductor switching element 34, the semiconductor switching element 34 breaks down and becomes conductive. The first capacitor 33 is then abruptly discharged via the transformer primary winding 35*a* of the transformer 35. This results in a voltage pulse which is induced in the transformer secondary winding 35*b*, as a result of which an excessively large instantaneous voltage is applied, via the further blocking capacitor 36, between the external auxiliary electrode 11 and the main electrode 4 of the discharge vessel 3.

As soon as the current through the semiconductor switching element 34 decreases to zero, the switching element becomes non-conductive again, after which the process described is repeated. This repetition will continue until a stable discharge has been formed in the discharge vessel between the main electrodes, at which time the arc voltage and hence the voltage across the starting circuit assumes a value such that the voltage across the first capacitor 33 remains below the breakdown voltage of the semiconductor switching element 34. In the case where the semiconductor switching element 34 is of the undirectional thyristor type, the process will be repeated only for one polarity of the applied alternating voltage. In the case of an embodiment of the circuit arrangement comprising a semiconductor switching element 34 of the bidirectional thyristor type, the process will be repeated for both polarities of the applied alternating voltage.

In a practical case, the lamp was operated with an alternating supply voltage of 220 V, 50 Hz, and the power consumed by the lamp was 113 W. The lamp was operated in combination with a ballast intended for the operation of a 125 W high-pressure mercury discharge lamp. The discharge vessel of the lamp contained, besides xenon at a pressure of 10 kPa at 300° K., 25 mg of mercury-sodium amalgam containing 18% by weight of Na. During operation, the luminous flux of the lamp was 11,000 lumen and the arc voltage between the main electrodes was 115 V. The electric starting circuit was proportioned as follows:

| | | |
|---|---|---|
| Resistor 32 | 56k Ω | |
| first capacitor 33 | 10 nF | |
| blocking capacitor 36 | 2.2 nF | |
| semiconductor breakdown element 34 | breakdown voltage 240 V<br>breakdown current 0.2 mA<br>breakdown time 0.5 μs | being a SIDAC, type Teccor K2400 F or Shindengen K 1V 24 |
| transformer 35 | number of primary turns 25<br>number of secondary turns 600. | |

During starting of the lamp, the charging current of the first capacitor was at most 6 mA for at most 50 μs. In the operating condition, the current through the starting circuit was 0.35 mA. The starting pulse produced in the starting circuit was 1500 V. Experiments have shown that the lamp ignites readily at an effective value of the alternating supply voltage of 170 V.

In another practical case, a high-pressure sodium discharge lamp was used and was operated via a suitable stabilization ballast at an alternating supply voltage of 220 V, 50 Hz. The power consumed by the lamp was 75 W; the luminous flux was 7100 lumen and the arc voltage was 100 V. The discharge vessel contained xenon at a pressure of 10 kPa at 300° K. and 25 mg of amalgam containing 18% by weight of Na. The electric starting circuit of this lamp was identical to the starting circuit of the lamp described hereinbefore. The current through the starting circuit during operation of the lamp was 0.3 mA. The starting pulse produced in the starting circuit was 1500 V. Also in this lamp, experiments have shown that the lamp ignites readily at an effective value of the supply voltage of 170 V.

Figure 4:
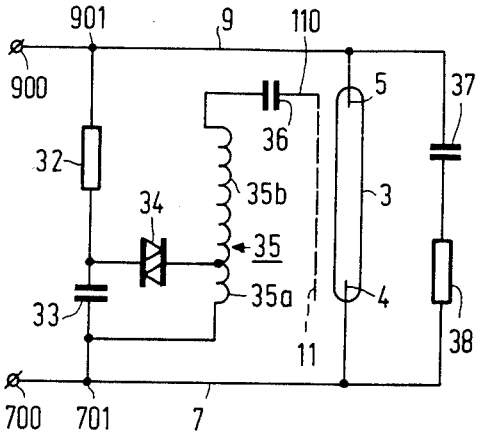

In FIG. 4, a modification of an electric starting circuit is shown, in which parts corresponding to those in FIG. 3 are provided with like reference numerals. In the modification shown, the discharge vessel is shunted by a series arrangement of a second resistor 38 and a second capacitor 37.

Figure 5:
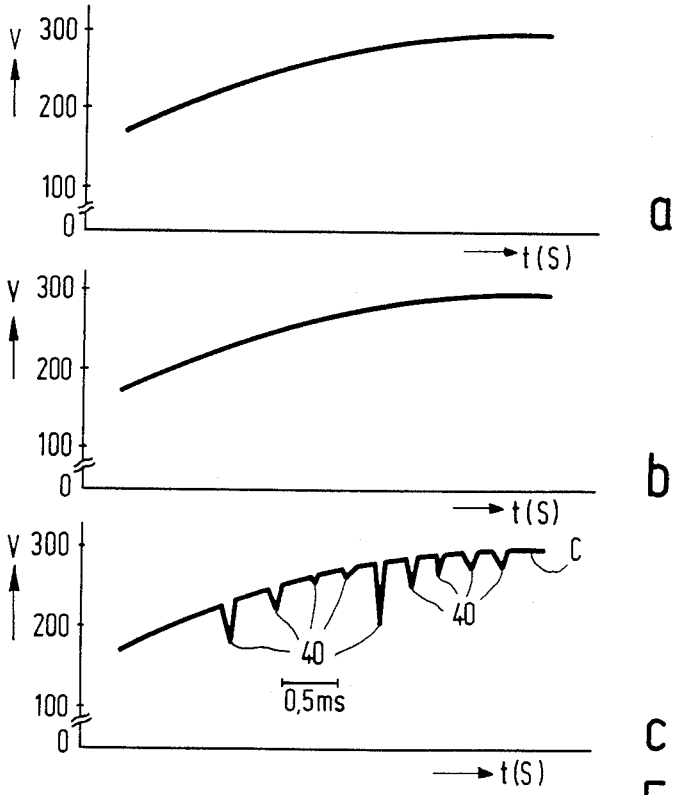

FIG. 5 shows a part of the voltage variation during starting of a lamp supplied by means of a circuit according to FIG. 4. Curve a indicates the variation of the supply voltage applied to the lamp and curve b indicates the variation of the voltage between the main electrodes 4 and 5. For comparison, curve c indicates the voltage variation between the main electrodes 4 and 5 of a lamp comprising a starting circuit of the kind shown in FIG. 3. It appears from the Figure that in the case of a starting circuit according to FIG. 3, the voltage applied between the main electrodes exhibits abrupt decreases 40 at instants at which the semiconductor switching element breaks down. With the use of the circuit shown in FIG. 4, such abrupt voltage variations do not occur.

In a practical case, the lamp was operated at an alternating supply voltage of 220 V, 50 Hz, and the power consumed by the lamp was 110 W. The electric starting circuit was proportioned as follows:

| | | |
|---|---|---|
| resistor 32 | 56 k Ω | |
| resistor 38 | 1 k Ω | |
| first capacitor 33 | 10 nF | |
| second capacitor 37 | 33 nF | |
| blocking capacitor | 2.2 nF | |
| semiconductor breakdown element 34 | breakdown voltage 240 V<br>breakdown current 0.2 mA<br>breakdown time 0.5 μs. | being a SIDAC type Teccor K2400 F or Shindengen K 1V 24 |
| transformer winding | number of primary turns 25<br>number of secondary turns 600. | |

The voltage variation between the electrodes 4 and 5 during starting is shown in curve b of FIG. 5.

In the case of the absence of the series arrangement of the second resistor and the second capacitor the voltage variation between the electrodes 4 and 5 was as shown in curve c in FIG. 5. The abrupt voltage decreases then had a value of up to approximately 100 V.

What is claimed is:

1. A high-pressure sodium discharge lamp comprising a discharge vessel provided with two main electrodes, between which electrodes a stable discharge extends in the operating condition of the lamp, said discharge vessel having an external auxiliary electrode, an electric starting circuit for the lamp including an electric circuit comprising a transformer primary winding, a first capacitor and a semiconductor switching element, said circuit being connected in series with a first resistor and electrically parallel between the two main electrodes and being connected electrically via a transformer secondary winding to the external auxiliary electrode, characterized in that the semiconductor switching element comprises an uncontrolled two-terminal voltage-dependent breakdown element of the uni- or bidirectional thyrisitor type having a breakdown current smaller than 1 mA at a breakdown time shorter than 10 μs, said semiconductor switching element providing a discharge path for the first capacitor to discharge into the primary winding.

2. A lamp as claimed in claim 1, characterized in that in the electric circuit the semiconductor switching element is connected between the first capacitor and the transformer primary winding and in that the first capacitor is directly connected to the first resistor.

3. A lamp as claimed in claim 2, characterized in that the lamp is shunted by a series arrangement of a second resistor and a second capacitor.

4. A lamp as claimed in claim 1, characterized in that the lamp is shunted by a series arrangement of a second resistor and a second capacitor.

5. A starter circuit for igniting an electric discharge lamp of the type having first and second main electrodes and an external auxiliary electrode comprising:

first and second input terminals for connection to a source of AC supply voltage, a transformer having a primary winding and a secondary winding and with the secondary winding coupled to said auxiliary electrode, a first capacitor, a semiconductor switching element comprising an uncontrolled voltage-dependent breakdown element having a thyristor characteristic and a breakdown current less than 1 ma at a breakdown time shorter than 10 μs, means coupling said first capacitor to said input terminals via a first resistor, means coupling said transformer primary winding to said first capacitor via said semiconductor switching element so that the first capacitor will discharge into the primary winding via the semiconductor switching element when the voltage across the first capacitor reaches the breakdown voltage of the semiconductor switching element thereby to induce an ignition pulse in the transformer secondary winding, and wherein said first resistor, first capacitor, semiconductor switching element and said primary winding form an electric circuit that is coupled to a pair of conductors for coupling the electric circuit across said first and second main electrodes of the discharge lamp.

6. A starter circuit as claimed in claim 5 wherein the semiconductor switching element is chosen to have a breakdown voltage in relation to the operating voltage of a discharge lamp to be coupled to the starter circuit such that the voltage across the first capacitor does not reach said breakdown voltage when a lamp is coupled to the starter circuit and is in its normal operating condition, whereby the starter circuit is inhibited from generating ignition pulses in the operating condition of a discharge lamp coupled thereto.

7. A starter circuit as claimed in claim 6 further comprising a second resistor and a second capacitor connected in a series circuit adapted to be connected in parallel with a discharge lamp when said lamp is coupled to the starter circuit.

8. A starter circuit as claimed in claim 5 further comprising a second resistor and a second capacitor connected in a series circuit adapted to be connected in parallel with a discharge lamp when said lamp is coupled to the starter circuit, said second resistor and second capacitor having an RC time constant so as to prevent a substantial drop in the voltage appearing across the lamp when the ignition pulses are generated.

9. A starter circuit as claimed in claim 5 wherein said first resistor and said first capacitor are connected in a series circuit across said pair of conductors and said semiconductor switching element and said transformer primary winding are connected in a further series circuit that shunts said first capacitor.

10. A starter circuit as claimed in claim 5 wherein the lamp to be ignited thereby comprises a high pressure sodium discharge lamp and the secondary winding is coupled to said auxiliary electrode via a coupling capacitor.

11. A starter circuit as claimed in claim 5 wherein the semiconductor switching element is chosen to have a breakdown voltage such that multiple ignition pulses are generated in each half cycle of the AC supply voltage during the ignition phase of a discharge lamp.

12. A starter circuit as claimed in claim 5 wherein the semiconductor switching element comprises a bidirectional two-terminal device of the thyristor type having a given breakdown voltage.

13. A discharge lamp having first and second main electrodes and an external auxiliary electrode and a base housing adapted to mount therein a starter circuit for igniting the lamp thereby to form an integral lamp-starter unit, said lamp including first and second internal conductors connected to said first and second main electrodes, respectively, for applying an AC supply voltage to the lamp, said base housing having means for coupling an external AC supply voltage to said first and second internal conductors, and wherein said starter circuit is mounted within said base housing and comprises:

a transformer having a primary winding and a secondary winding with the secondary winding coupled to said auxiliary electrode, a first capacitor, a semiconductor switching element comprising an uncontrolled voltage-dependent breakdown element having a thyristor characteristic and a breakdown current less than 1 ma at a breakdown time shorter than 10 μs, means coupling said first capacitor to said first and second internal conductors via a first resistor, means coupling said transformer primary winding to said first capacitor via said semiconductor switching element so that the first capacitor will discharge into the primary winding via the semiconductor switching element when the voltage across the first capacitor reaches the breakdown voltage of the semiconductor switching element thereby to induce an ignition pulse in the transformer secondary winding, and wherein said first resistor, first capacitor, semiconductor switching element and said primary winding form an electric circuit that is coupled in parallel with the main electrodes of the lamp.

14. A lamp-starter unit as claimed in claim 13 further comprising a second resistor and a second capacitor connected in a series circuit that is coupled to said first and second main electrodes so that said series circuit is effectively in parallel with the lamp.

15. A lamp-starter unit as claimed in claim 13 wherein said first resistor and said first capacitor are connected in a series circuit across said first and second internal conductors and said semiconductors switching element and said transformer primary winding are connected in a further series circuit that shunts said first capacitor.

16. A lamp-starter unit as claimed in claim 13 wherein the lamp comprises a high pressure sodium discharge lamp and the semiconductor switching element comprises a bidirectional two-terminal device of the thyristor type having a given breakdown voltage.

17. A lamp as claimed in claim 1 wherein said first resistor is part of a charge path for the first capacitor that bypasses said primary winding.

18. A starter circuit as claimed in claim 5, wherein said first resistor is part of a charge path for the first capacitor that bypasses said primary winding.

* * * * *